US009975694B1

(12) United States Patent
Foster

(10) Patent No.: US 9,975,694 B1
(45) Date of Patent: May 22, 2018

(54) WASTE CONTAINER

(71) Applicant: REHRIG PACIFIC COMPANY, Los Angeles, CA (US)

(72) Inventor: Derick Foster, Cumming, GA (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 0 days. days.

(21) Appl. No.: 15/659,160

(22) Filed: Jul. 25, 2017

(51) Int. Cl.
*B65F 1/14* (2006.01)
*B65F 1/16* (2006.01)

(52) U.S. Cl.
CPC ..... *B65F 1/1473* (2013.01); *B65F 1/1452* (2013.01); *B65F 1/16* (2013.01); *B65F 2250/114* (2013.01)

(58) Field of Classification Search
CPC ..... B65F 1/1473; B65F 1/16; B65F 1/1452; B65F 2250/114
See application file for complete search history.

(56) References Cited

U.S. PATENT DOCUMENTS

D281,284 S 11/1985 Reuter
D292,638 S 11/1987 Carville
4,749,101 A 6/1988 Durkan, Jr.
4,836,394 A 6/1989 Glomski
4,930,649 A 6/1990 Moser
D313,491 S 1/1991 Edelhoff et al.
D323,912 S 2/1992 Delmerico
D323,914 S 2/1992 Doxey et al.
5,167,351 A * 12/1992 Prout ..... B65F 1/1468 220/840
5,261,562 A 11/1993 Prout et al.
D347,095 S 5/1994 Apps et al.
5,356,027 A 10/1994 Craft et al.
D355,514 S * 2/1995 Breen ..... D34/1
D355,741 S 2/1995 Craft et al.
D365,428 S 12/1995 Prout et al.
5,538,158 A * 7/1996 Prout ..... B29C 33/0033 220/675
5,582,322 A 12/1996 Prout et al.
D388,577 S 12/1997 Rehrig et al.
5,776,405 A * 7/1998 Prout ..... B29C 41/003 220/675
D398,120 S 9/1998 Rehrig et al.
D429,398 S * 8/2000 Wysocki ..... D34/1
(Continued)

OTHER PUBLICATIONS

Rehrig Pacific '95 EG—2015' Dated Jan. 2016.
Rehrig Pacific '95 EV—2014' Dated Jan. 2015.

*Primary Examiner* — Jacob B Meyer
(74) *Attorney, Agent, or Firm* — Carlson, Gaskey & Olds, P.C.

(57) ABSTRACT

A waste container includes a base wall and an outer wall extending upward from a periphery of the base wall to define an upper opening. The outer wall includes an upper portion and a lower portion. The upper portion has a larger dimension in a forward and rearward direction than the lower portion. A vertical stress channel is formed in a rear portion of the outer wall. The vertical channel extends across the lower portion of the outer wall and upward partially into the upper portion. A lid may be pivotably mounted relative to the outer wall at a rear of the waste container to selectively cover the upper opening. A plurality of wheels are rotatably connected proximate a lower rear edge of the outer wall.

4 Claims, 8 Drawing Sheets

(56) References Cited

U.S. PATENT DOCUMENTS

D445,228 S * 7/2001 Apps ..... D34/25
6,276,557 B1 * 8/2001 Wysocki ..... B65F 1/02 220/608
6,280,001 B1 * 8/2001 Parker ..... B60B 37/10 301/111.03
D468,071 S 12/2002 Le et al.
D471,336 S 3/2003 Tuduri
D474,317 S 5/2003 Tuduri
D491,328 S * 6/2004 Aiken ..... D34/5
6,902,080 B2 6/2005 Busch
7,100,791 B2 9/2006 Berger
7,114,631 B2 * 10/2006 Aiken ..... B65F 1/1468 220/766
D532,173 S * 11/2006 Aiken ..... D34/5
D535,448 S 1/2007 Kilduff et al.
D552,320 S 10/2007 Presnell et al.
7,287,665 B2 10/2007 Meissen et al.
D568,022 S 4/2008 Bureau et al.
D573,322 S * 7/2008 Blanchard ..... D34/10
D577,170 S 9/2008 Meers
7,464,829 B1 * 12/2008 Koefelda ..... B65F 1/004 220/532
D594,169 S 6/2009 Connor et al.
D624,723 S 9/2010 Raghunathan et al.
D641,121 S 7/2011 Rampton et al.
D643,174 S 8/2011 Raghunathan et al.
8,096,565 B2 * 1/2012 Meers ..... B65F 1/02 220/671
D657,106 S 4/2012 Talbot Pouliot et al.
8,146,774 B2 4/2012 Parker et al.
8,424,714 B2 4/2013 Kruse et al.
8,424,715 B2 * 4/2013 Aiken ..... B65F 1/1468 220/761
8,430,267 B2 4/2013 Kilduff et al.
8,714,404 B2 5/2014 Raghunathan et al.
8,720,686 B1 5/2014 Shuman
D707,905 S 6/2014 Nolet et al.
D707,906 S 6/2014 Nolet et al.
D707,907 S 6/2014 Nolet et al.
D707,908 S 6/2014 Nolet et al.
8,919,791 B2 * 12/2014 Foster ..... B62B 1/00 280/43
9,096,097 B2 * 8/2015 Trent, III ..... B65F 1/1473
D753,364 S 4/2016 Labrecque et al.
9,365,346 B2 * 6/2016 McDade ..... B65F 1/122
9,434,538 B2 9/2016 Yang et al.
D771,893 S 11/2016 Del Rosario Roy et al.
9,550,395 B2 * 1/2017 Trent, III ..... B65F 1/1473
9,738,444 B1 * 8/2017 Uffner ..... B65F 1/1473
2003/0213808 A1 11/2003 Berger
2004/0074913 A1 4/2004 McDade
2004/0206759 A1 10/2004 Busch
2004/0222231 A1 * 11/2004 Aiken ..... B65F 1/1468 220/759
2007/0029338 A1 * 2/2007 Aiken ..... B65F 1/1468 220/766
2008/0093436 A1 * 4/2008 Bolhous ..... G06Q 30/04 235/375
2008/0094224 A1 * 4/2008 Parker ..... B65F 1/1484 340/572.8
2009/0127809 A1 * 5/2009 Meers ..... B65F 1/02 280/47.26
2013/0048654 A1 * 2/2013 Kilduff ..... B65F 1/122 220/694
2013/0119625 A1 * 5/2013 Foster ..... B65F 1/1473 280/43
2013/0234409 A1 * 9/2013 Lin ..... B62B 1/16 280/47.26
2013/0334782 A1 * 12/2013 Trent, III ..... B65F 1/1473 280/79.2
2014/0299619 A1 * 10/2014 Foster ..... B65F 1/1615 220/820
2015/0259139 A1 * 9/2015 Yang ..... B65F 1/1646 220/263
2015/0306911 A1 * 10/2015 Trent, III ..... B65F 1/1473 280/79.2
2017/0210558 A1 * 7/2017 Boyea ..... B65F 1/10

* cited by examiner

WASTE CONTAINER

BACKGROUND

Plastic waste containers, such as for trash, recycling, or organic waste (compost), etc. include a body portion having an upper opening. A lid may be pivotably secured thereto to selectively close the upper opening to the body portion. Many waste containers further include at least one pair of wheels to facilitate moving the container when full, also called a roll-out cart.

In a growing number of areas, collection trucks include mechanical lifting equipment for lifting and dumping the container into the truck. There are different styles of lifters. Some grab two points on the front of the containers, an upper attachment envelope and a lower grab bar. Other lift mechanisms include a pair of arms that squeeze the sides of the body portion of the container to lift and dump the container. Even within these two general types of lift mechanisms, there are many differences in lift equipment. Each style of lift equipment induces a different set of stresses on the plastic structure of the containers. Numerous stress cycles on the containers over years can cause breakage.

SUMMARY

A waste container includes an outer wall extending upward from a periphery of a base wall to define an upper opening. The outer wall includes an upper portion and a lower portion. The upper portion has a larger dimension in a forward and rearward direction than the lower portion. A vertical stress channel is formed in a rear portion of the outer wall. The vertical channel extends across the lower portion of the outer wall and upward partially into the upper portion.

A lid is pivotably mounted relative to the outer wall at a rear of the waste container to selectively cover the upper opening. A plurality of wheels are rotatably connected proximate a lower rear edge of the outer wall.

The container may further include a pair of front shoulder portions transitioning between the upper portion and the lower portion in the front portion of the outer wall. The front shoulder portions are formed on either side of the upper recess. A pair of front faces are formed on the upper portion above the front shoulder portions. In the example container, the front faces are co-planar and are angled downward and inward.

DETAILED DESCRIPTION OF THE DRAWINGS

Figure 1:
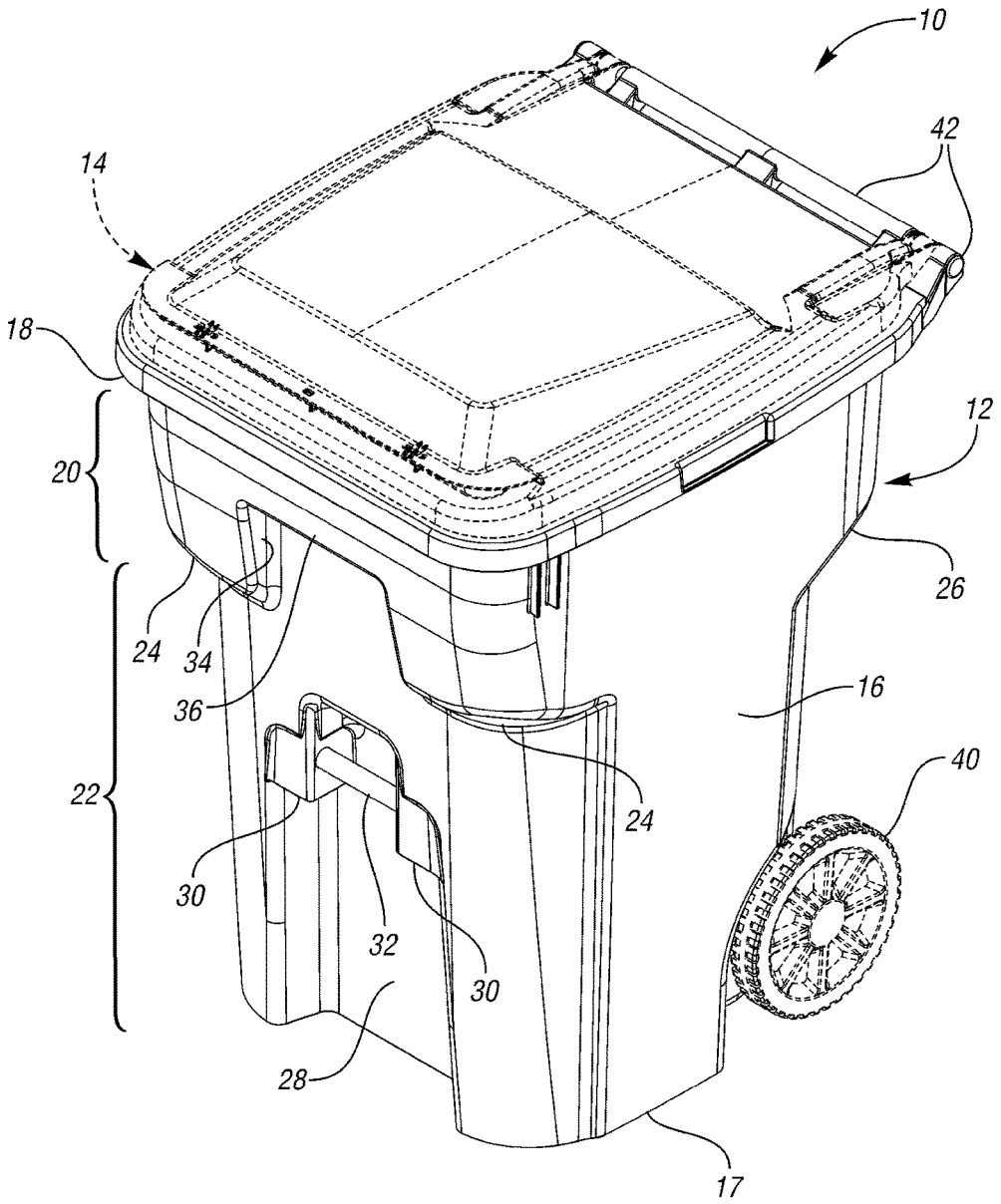
FIG. 1 is a perspective view of a waste container according to one embodiment.

A waste container 10, more specifically a roll out cart 10, is shown in FIG. 1. The waste container 10 includes a body portion 12 and a lid 14. The body portion 12 includes an outer wall 16 having a somewhat rectangular cross section extending upward from a base wall 17 to a mouth of the body portion 12 which is selectively covered by the lid 14. An upper edge of the body portion 12 includes a lip 18 projecting outward and then downward.

The body portion 12 generally includes an upper portion 20 and a lower portion 22. The upper portion 20 is larger than the lower portion 22 in the rearward direction and the forward direction, although the side walls may be only moderately tapered (as shown). This makes the body portion 12 of the waste container 10 substantially nestable with identical body portions 12 when empty. Front shoulders 24 transition the upper portion 20 to the lower portion 22 in the front corners of the body portion 12. Rear shoulders 26 transition the upper portion 20 to the lower portion 22 in the rear corners of the body portion 12. The shoulders 24, 26 have large radiuses, curved transition lines and no 90 degree angles.

The front of the outer wall 16 includes a lower recess 28 in the lower portion 22 that is open through the base 17 of the body portion 12. A pair of brackets 30 support a lower grab bar 32. An upper recess 34 in the upper portion 20 opens downwardly and defines an upper attachment envelope 36 at an upper edge thereof.

A pair of wheels 40 are mounted proximate the rear of the base 17. The lid 14 is hingeably connected to a handle portion 42 spaced rearwardly of an upper edge of the body portion 12.

Figure 2:
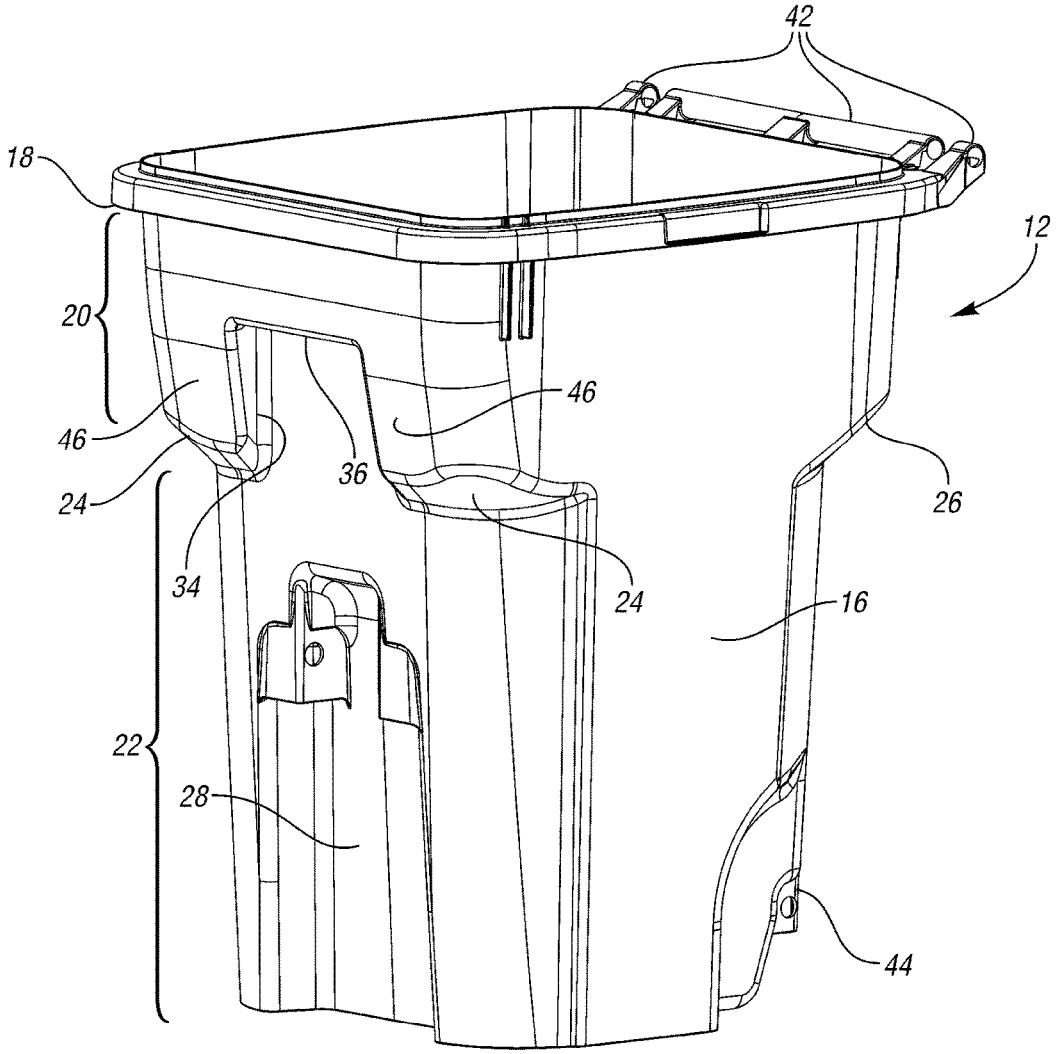
FIG. 2 is a perspective view of the body portion of FIG. 1.

FIG. 2 is a front perspective view of the body portion 12 of FIG. 1. The body portion 12 is preferably injection molded as a single piece of suitable plastic. The front of the upper portion 20 includes a front face 46 on either side of the upper recess 34. The front faces 46 extend from approximately the height of the upper attachment envelope 36 down to the front shoulders 24. The front faces 46 are generally planar and co-planar but are angled inward as they extend downward, as will be explained. With the wheels 40 (FIG. 1) removed in FIG. 2, one of the brackets 44 for holding the wheel axle can be seen.

Figure 3:
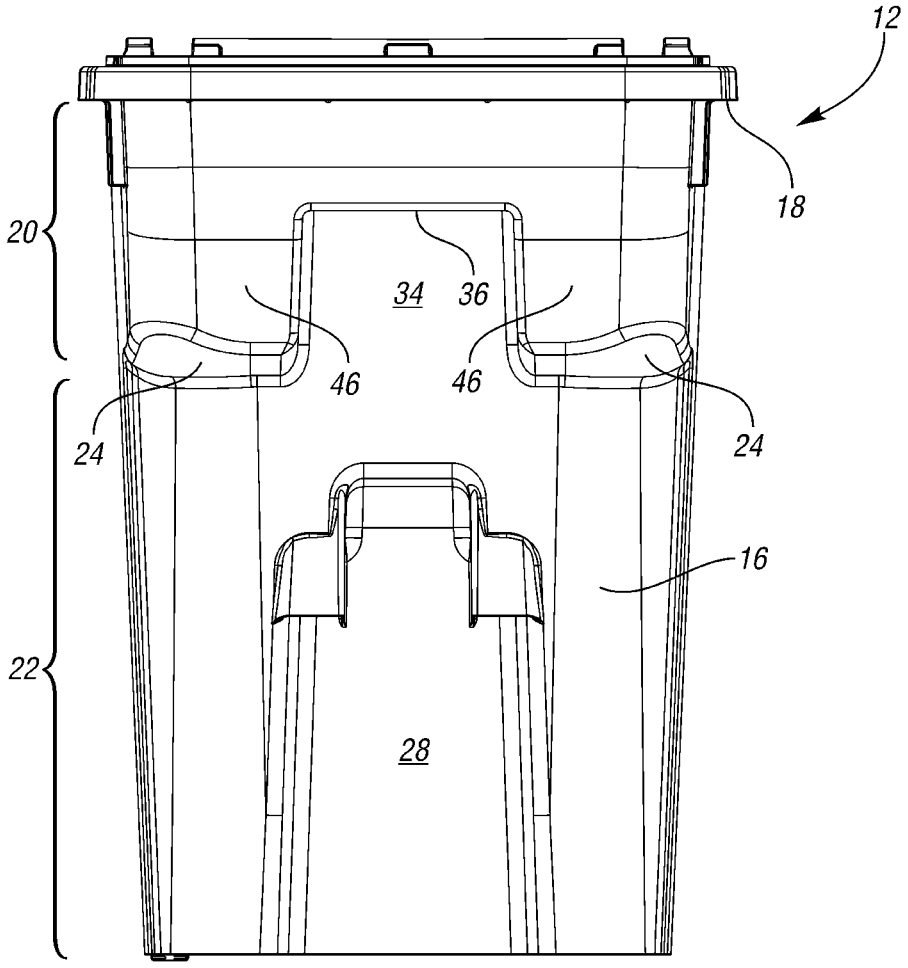
FIG. 3 is a front view of the body portion of FIG. 2.

FIG. 3 is a rear view of the body portion 12. As shown, the front shoulders 24 curve upward in the corners of the body portion 12 as they transition from the upper portion 20 to the lower portion 22. The front faces 46 are on either side of the upper recess 34 above the front shoulders 24.

Figure 4:
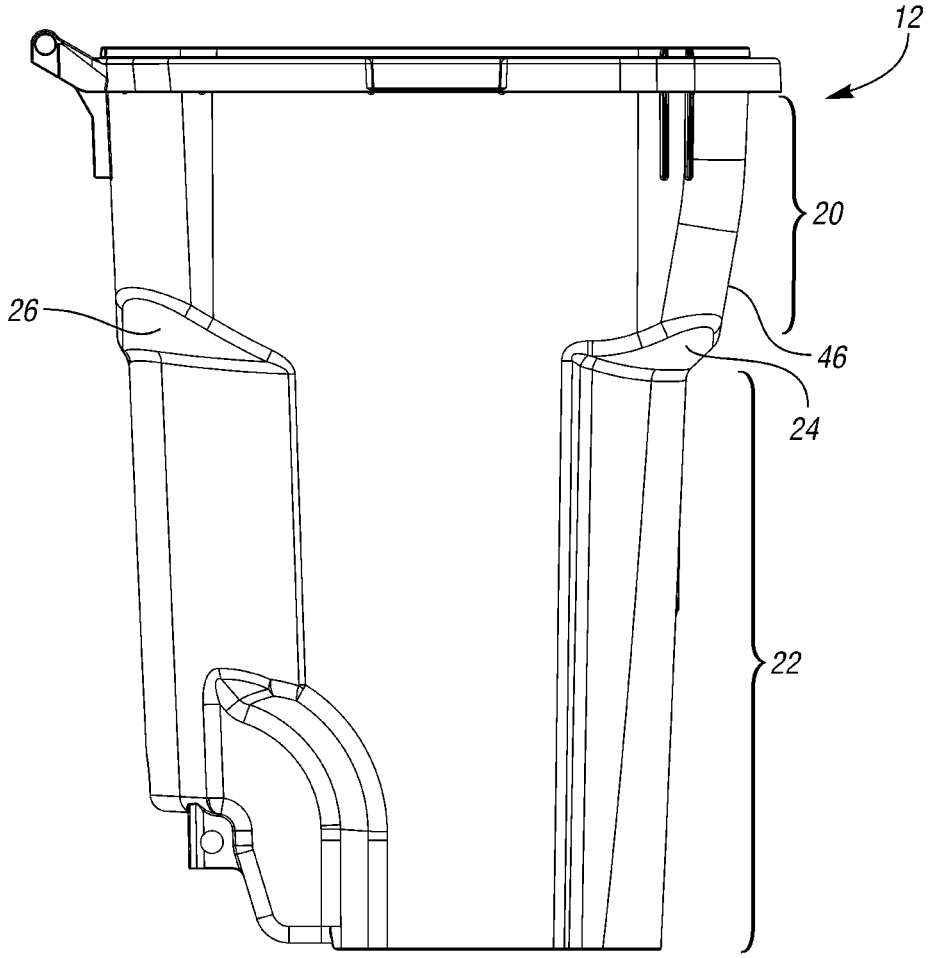
FIG. 4 is a side view of the body portion of FIG. 2.

FIG. 4 is a side view of the body portion 12. Again, the front shoulders 24 curve upward in the corners of the body portion 12. Also, the rear shoulders 26 curve upward in the rear corners of the body portion 12.

Figure 6:
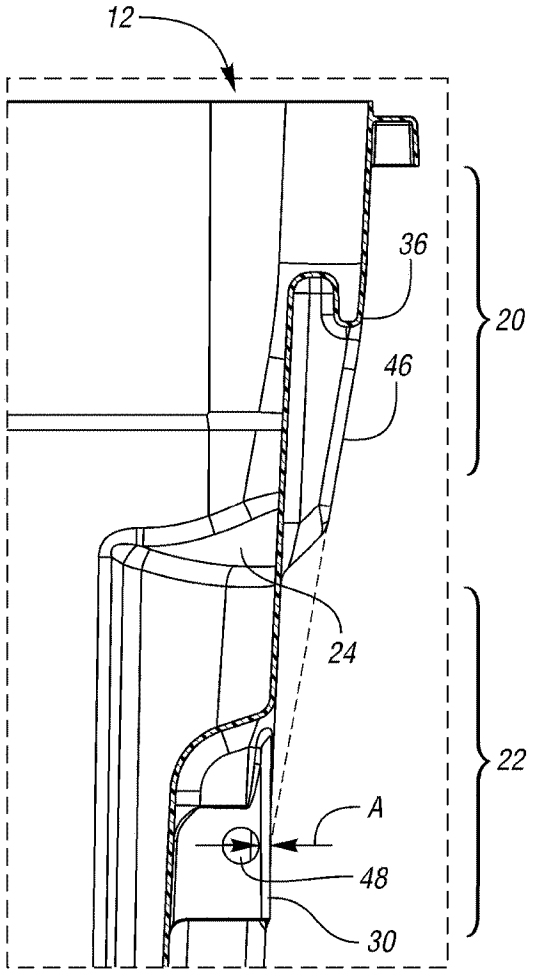
FIG. 6 is an enlarged view of a portion of the body portion of FIG. 5.
Figure 5:
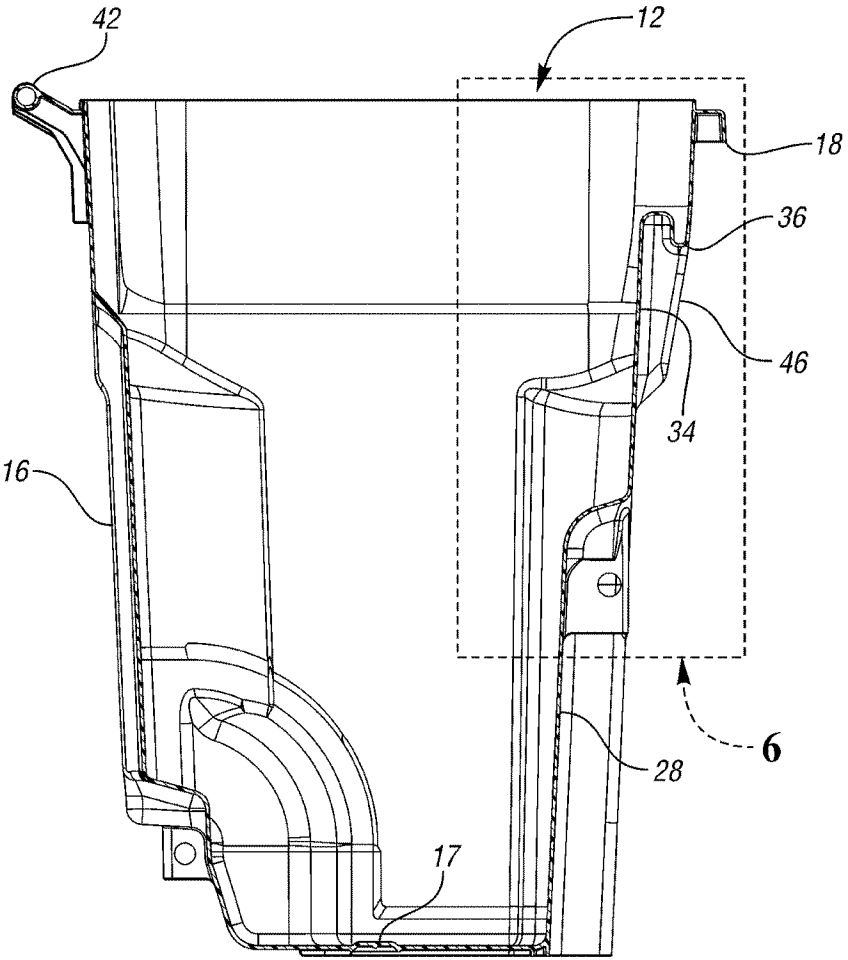
FIG. 5 is a section view of the body portion of FIG. 2.

FIG. 5 is a section view through the body portion 12. FIG. 6 is an enlarged portion of FIG. 5, namely the upper front portion of the body portion 12 of FIG. 5. As shown in FIG. 6, the front faces 46 (one shown) are planar and extend downward and inward from about the height of the upper attachment envelope 36. The plane of the front faces 46 intercepts the front surface of the body portion 12 approximately at the aperture 48 for the grab bar 32 (FIG. 1). In this example the intercept is at a distance A that is less than half an inch from the aperture 48, and more specifically 0.4 inches from the aperture 48. As a result, when the lift mechanism grabs the upper attachment envelope 36 and grab bar 32 (FIG. 1), the front faces 46 will contact a mating surface of the lift mechanism with less stress on the body portion 12.

Figure 7:
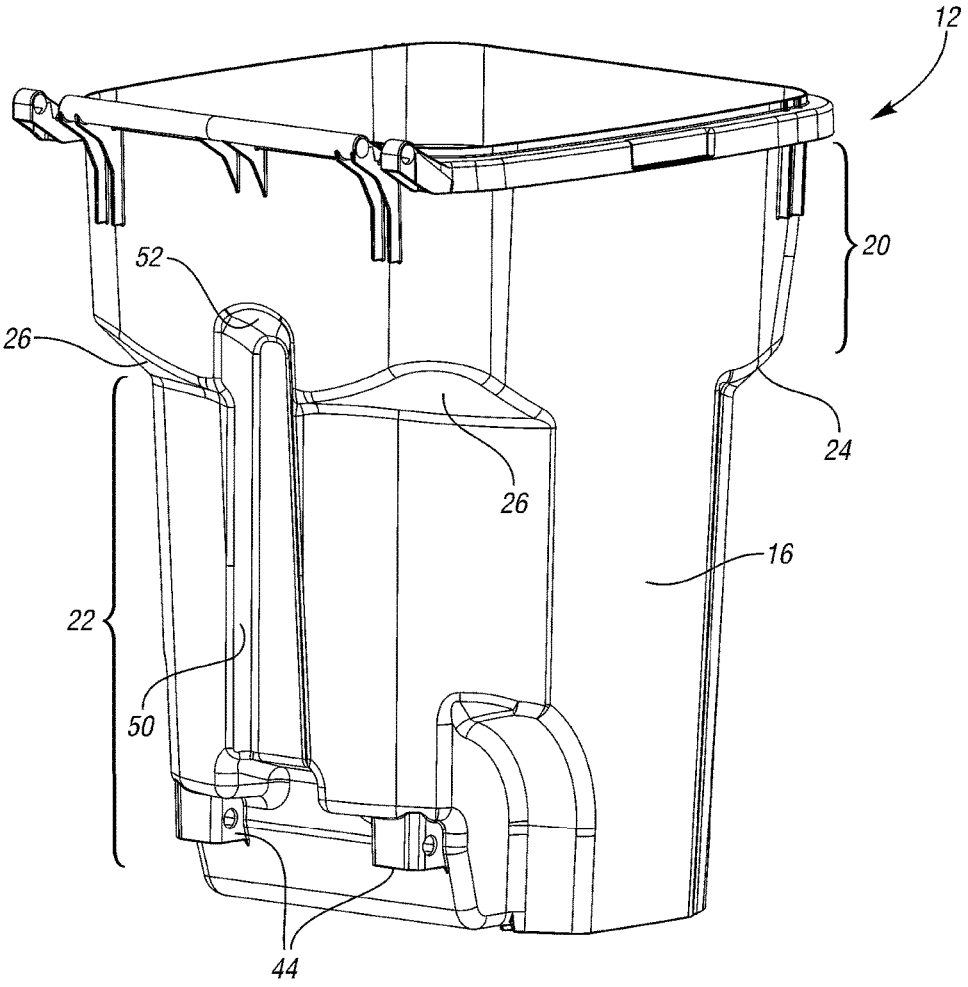
FIG. 7 is a rear perspective view of the body portion of FIG. 2.

FIG. 7 is a rear perspective view of the body portion 12. As shown, a vertical stress channel 50 is formed in the center of the rear of the outer wall 16. The vertical stress channel 50 is formed in the entire lower portion 22 of the rear of the outer wall 16, extending into a lower recess in which the wheel axle brackets 44 are located. The vertical stress channel 50 also extends upward into the upper portion 20 higher than the rear shoulders 26. The vertical stress channel 50 forms an arch 52 at an uppermost end thereof.

Figure 8:
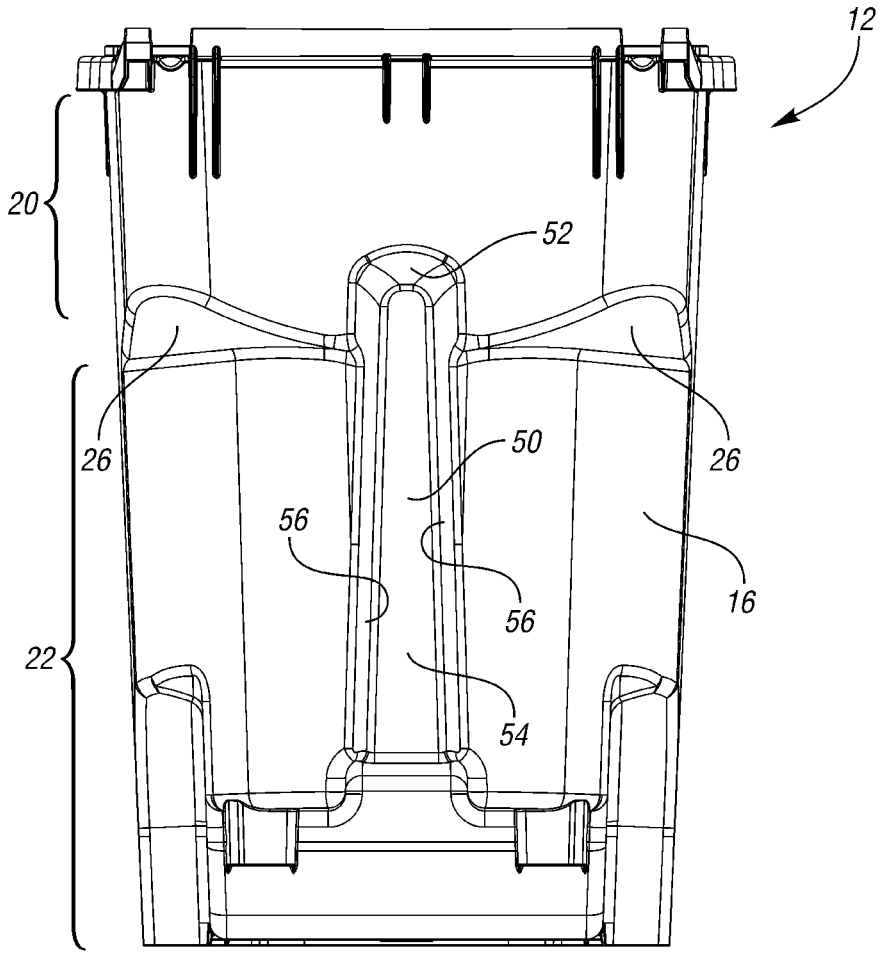
FIG. 8 is a rear view of the body portion of FIG. 2.

As shown in FIGS. 7 and 8, the vertical stress channel 50 includes a bottom wall 54 and an angled transition wall 56 between the outer wall 16 and the bottom wall 54. The transition wall 56 also extends around the arch 52 of the vertical stress channel 50.

Figure 10:
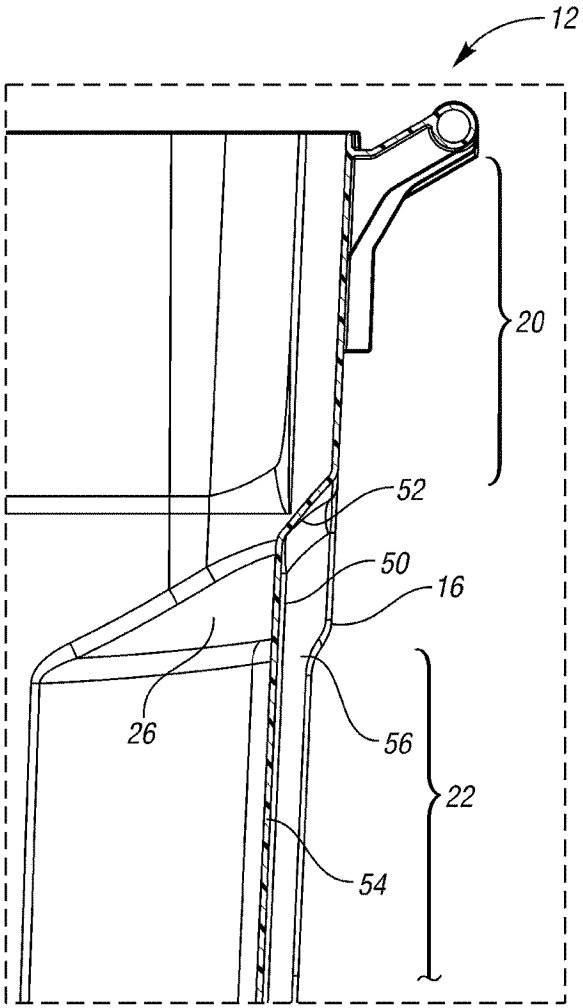
FIG. 10 is an enlarged view of a portion of the body portion of FIG. 9.
Figure 9:
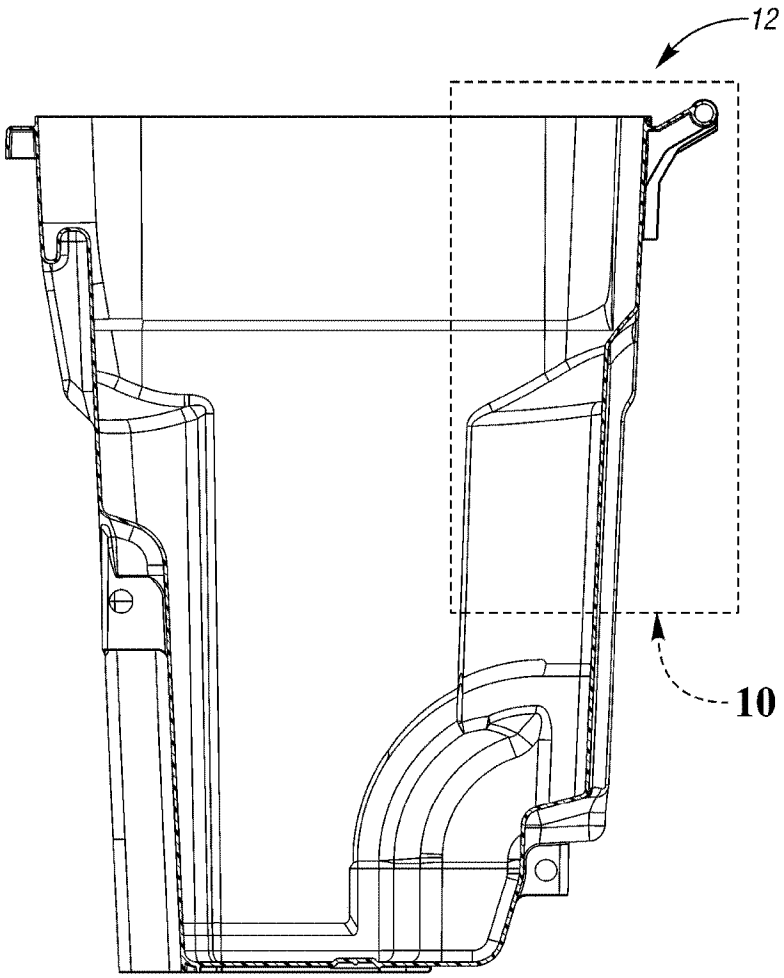
FIG. 9 is a section view of the body portion of FIG. 2.

FIG. 9 is a section view through the body portion 12. FIG. 10 is an enlarged view of an upper rear portion of FIG. 9. As shown in FIG. 10, the transition wall 56 in the arch 52 transitions to the bottom wall 54 at a height approximately even with the upper curve of the rear shoulders 26 at the rear corners of the body portion 12.

In use, when a lift mechanism squeezes the sides of the body portion 12 toward one another, the vertical stress channel 50 can flex and relieve some of the force and stress that would otherwise act on the rear of the outer wall 16 of the body portion 12, including the corners. The rear shoulders 26 also spread out the flexure to prevent the concentration of stress in any one area around the rear corners of the body portion 12, especially in the transition between the upper portion 20 and lower portion 22. The front shoulders 24 similarly reduce stress concentration in the front corners of the body portion 12 in the transition between the upper portion 20 and lower portion 22.

The vertical stress channel 50 also increases the rigidity of the outer wall 16 at the upper rear of the body portion 12. This reduces bulging of the upper rear of the outer wall 16 when the container 10 is loaded.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A waste container comprising:

a base wall;

an outer wall extending upward from a periphery of the base wall to define an upper opening, the outer wall including an upper portion and a lower portion, the upper portion having a larger dimension in a forward and rearward direction than the lower portion, the outer wall including rear shoulder portions between the upper portion and the lower portion in the rear portion of the outer wall in rear corners of the waste container, wherein the rear shoulder portions curve upward in the rear corners of the waste container, an upper recess formed in a front portion of the upper portion of the outer wall, the upper recess further defining an upper attachment envelope at an upper end thereof, the front portion of the outer wall further including a lower recess in which a grab bar is secured;

front shoulder portions transitioning between the upper portion and the lower portion in the front portion of the outer wall, wherein the front shoulder portions are formed on either side of the upper recess;

front faces formed on the upper portion above the front shoulder portions, wherein the front faces are co-planar and are angled downward and inward, wherein the front faces are in a plane that intercepts the lower portion of the outer wall at approximately a height of the grab bar;

a vertical stress channel formed in a rear portion of the outer wall, the vertical stress channel extending across the lower portion of the outer wall and upward partially into the upper portion, wherein the vertical stress channel extends upward higher than the rear shoulder portions;

a lid pivotably mounted to a handle portion spaced rearwardly of an upper edge of the outer wall to selectively cover the upper opening; and a plurality of wheels rotatably connected proximate a lower rear edge of the outer wall.

2. A waste container comprising:

a base wall;

an outer wall extending upward from a periphery of the base wall to define an upper opening, the outer wall including an upper portion and a lower portion, the upper portion having a larger dimension in a forward and rearward direction than the lower portion, further including rear shoulder portions between the upper portion and the lower portion in a rear portion of the outer wall formed in rear corners of the waste container, wherein the rear shoulder portions curve upward in the rear corners of the waste container;

an upper recess formed in a front portion of the upper portion of the outer wall, the upper recess formed behind the front portion of the upper portion of the outer wall and opening downwardly and defining an upper attachment envelope at an upper end thereof;

a lower recess formed in the front portion of the lower portion of the outer wall;

a grab bar secured in the lower recess;

a pair of front shoulder portions transitioning between the upper portion and the lower portion in the front portion of the outer wall, wherein the front shoulder portions are formed on either side of the upper recess, a pair of front faces formed on the upper portion above the front shoulder portions, wherein the front faces are co-planar and are angled downward and inward from the front portion of the upper portion of the outer wall, wherein the front faces are in a plane that intercepts the lower portion of the outer wall at approximately a height of the grab bar; and a lid pivotably mounted relative to the outer wall at a rear of the waste container to selectively cover the upper opening.

3. The waste container of claim 2 wherein the outer wall includes a lip extending outward and downward from an uppermost front edge of the outer wall, wherein the lip is spaced upward and outward of the front portion of the upper portion of the outer wall.

4. A waste container comprising:

a base wall;

an outer wall extending upward from a periphery of the base wall to define an upper opening, the outer wall including an upper portion and a lower portion, the upper portion having a larger dimension in a forward and rearward direction than the lower portion, wherein the outer wall includes a lip extending outward and downward from an uppermost front edge of the outer wall;

an upper recess formed in a front portion of the upper portion of the outer wall, the upper recess formed behind the front portion of the upper portion of the outer wall and opening downwardly and defining an upper attachment envelope at an upper end thereof, wherein the lip is spaced upward and outward of the front portion of the upper portion of the outer wall;

a lower recess formed in the front portion of the lower portion of the outer wall;

a grab bar secured in the lower recess;

a pair of front shoulder portions transitioning between the upper portion and the lower portion in the front portion of the outer wall, wherein the front shoulder portions are formed on either side of the upper recess, a pair of front faces formed on the upper portion above the front shoulder portions, wherein the front faces are co-planar and are angled downward and inward from the front portion of the upper portion of the outer wall, wherein the front faces are in a plane that intercepts the lower portion of the outer wall at approximately a height of the grab bar;

rear shoulder portions between the upper portion and the lower portion in rear corners of the outer wall, wherein the rear shoulder portions curve upward in the rear corners of the waste container; and a lid pivotably mounted to a handle portion spaced rearwardly of the outer wall of the waste container to selectively cover the upper opening.

* * * * *